US007227735B2

(12) United States Patent
Hasenauer et al.

(10) Patent No.: US 7,227,735 B2
(45) Date of Patent: Jun. 5, 2007

(54) CURRENT REGULATED, VOLTAGE LIMITED, AC POWER SUPPLY WITH DC OFFSET FOR CORONA CHARGERS

(75) Inventors: Charles Herbert Hasenauer, Rochester, NY (US); Soenke Schmidt, Kiel (DE); Andreas Dickhoff, Kirchheim Teck (DE)

(73) Assignee: Eastman Kodak Company, Rochester, NY (US)

( * ) Notice: Subject to any disclaimer, the term of this patent is extended or adjusted under 35 U.S.C. 154(b) by 379 days.

(21) Appl. No.: 10/961,782

(22) Filed: Oct. 8, 2004

(65) Prior Publication Data

US 2005/0111890 A1 May 26, 2005

Related U.S. Application Data

(60) Provisional application No. 60/524,562, filed on Nov. 24, 2003.

(51) Int. Cl.
*G03G 15/02* (2006.01)
*H05F 3/00* (2006.01)
*H01T 23/00* (2006.01)

(52) U.S. Cl. ..... 361/225; 361/230; 361/231

(58) Field of Classification Search ..... 361/225, 361/230, 231
See application file for complete search history.

(56) References Cited

U.S. PATENT DOCUMENTS 6,831,818 B2 * 12/2004 Dickhoff et al. ..... 361/18

* cited by examiner

*Primary Examiner*—Stephen W. Jackson
*Assistant Examiner*—Dharti H. Patel
(74) *Attorney, Agent, or Firm*—Lawrence P. Kessler

(57) ABSTRACT

An apparatus and method for powering opposing corona chargers for discharging moving receiver sheets. The discharging capacity of the chargers is expanded by adding a high voltage DC offset to a current regulated, AC voltage limited power supply.

25 Claims, 2 Drawing Sheets

CURRENT REGULATED, VOLTAGE LIMITED, AC POWER SUPPLY WITH DC OFFSET FOR CORONA CHARGERS

CROSS REFERENCE TO RELATED APPLICATION

Reference is made to and priority claimed from U.S. Provisional Application Ser. No. 60/524,562, filed on Nov. 24, 2003, entitled: CURRENT REGULATED, VOLTAGE LIMITED, AC POWER SUPPLY WITH DC OFFSET FOR CORONA CHARGERS.

FIELD OF THE INVENTION

The present invention relates to corona chargers, and more particularly, to a power supply for a corona charger utilized in an electrophotographic reproduction apparatus to discharge receiver members.

BACKGROUND OF THE INVENTION

In electrophotographic reproduction apparatus and printers, an electrostatic latent image is formed on a photoconductive imaging member by first uniformly charging the imaging member and then image-wise exposing the imaging member using various light sources such as a scanned laser, LED array, optical flash, or other suitable, known methods. The electrostatic latent image is then developed into a visible image by bringing the imaging member into close proximity with an electrostatic developer that includes charged marking particles. In a 2-component developer, marking particles are mixed with larger, magnetic particles called carrier particles, where the marking particles become triboelectrically charged by contact with the carrier particles. The developer is contained in a development station that typically includes a roller with a magnetic core. The carrier particles transport the marking particles into contact with the imaging member bearing the electrostatic latent image. The development station is suitably biased and the marking particles suitably charged so that the proper amount of marking particles, are deposited in electrostatic image the regions of the imaging member.

After the electrostatic latent image on the imaging member has been developed, the developed image is generally transferred to a receiver member, such as sheets of paper or transparency stock. This is generally accomplished by applying an electric field in such a manner to urge the marking particles from the imaging member to the receiver member. In some instances, it is preferable to first transfer the developed image from the imaging member to an intermediate member and then from the intermediate member to the receiver member. Again, this is most commonly accomplished by applying an electric field to urge the developed image toward the appropriate receiver member. The receiver member bearing the developed image is then passed through a fusing device to permanently affix the developed image to the receiver member by heat and/or pressure. The marking particles are typically a thermoplastic polymer that is electrically non-conductive. The process of transferring the developed image to the receiver results in a polar electrostatic charge on the surfaces of the marking particle image and the receiver member. The polar charge will dissipate through a conductive receiver member such as moisture-containing paper, but will not migrate through the insulating marking particle image layer or the insulating receiver member. The result is trapped electrostatic charge on the imaged receiver member. On a conducting receiver member, the amount of trapped charge is dependent on the coverage of the marking particle image. The trapped charge can inconvenience the user of the printed receiver members, as the member sheets will tend to stick together by the electrostatic forces of attraction between the charges on adjacent sheets.

It is well known to use an ac corona discharge to dissipate electrostatic charges on the surfaces of moving webs. For example, two AC corona chargers, facing each other on opposite sides of the web are typically used. Current regulated, high voltage AC power supplies are typically used to power the corona chargers in these exemplary configurations. In attempting to use a pair of corona chargers in this way to discharge receiver members, new problems are encountered due to the interframe spaces between successive receiver members. The resistivity between the two opposing chargers changes significantly when a receiver member is between the two chargers, versus during an interframe when no receiver member is between the two chargers. With pure current regulation the corona wire voltage can increase to critical, high values when a receiver member is in between the two chargers. The voltage would also vary with different types of receiver members because of the variation in receiver member resistivity. When a highly resistive member exits the area between the opposed chargers it is possible for an arc to develop between the opposing corona wires. This can happen before the current regulation control of the power supply can reduce the output voltage of the supply to react to the change in resistance between the corona wires.

Arcing results in undesired electrical noise radiated into the control system of the reproduction apparatus and possibly to the environment around the machine. Arcing can also be damaging to the apparatus hardware and materials. If, to address this problem, a pure peak to peak voltage regulating power supply is used, the current would reach critical, high levels when the interframe, between successive receiver member, is in between the two chargers. In this mode, the chargers will be operating at an unnecessarily high power level and generate excessive heat in the power supply. At the corona wire, the corona emission and the resultant chemical emissions will also be unnecessarily high.

In co-pending U.S. patent application Ser. No. 09/866,182 (in the name of Hasenauer), a novel power supply is disclosed, hereafter referred to as the Hasenauer power supply, for powering a pair of opposed AC corona chargers for dissipating the trapped polar charge on the receiver members, that solves these problems. The Hasenauer power supply uses a combination of both output control methods, current regulation, and peak to peak voltage regulation, to provide a solution that prevents arcing and over-current loading for receiver member sheet fed applications. Driven by the resistance between the two chargers, the power supply changes automatically from current regulation to voltage limit mode. However, due to limited output current capacity, the Hasenauer power supply becomes less effective at very high receiver member speeds.

SUMMARY OF THE INVENTION

In view of the foregoing discussion, an object of this invention is to provide improved apparatus for removing electrostatic charge from receiver members receiving marking particle images in electrophotographic reproduction apparatus. Accordingly, there is herein provided a high voltage power supply for electrostatically discharging marking particle bearing receiver members from a sheet fed reproduction apparatus that addresses the prior needs for a more effective power regulation system that can charge corona wires while preventing arcing and over current loading for sheet fed applications. The power supply has two high voltage outputs that are RMS current regulated with a regulated DC voltage offset and peak-to-peak voltage limited. Each corona wire is connected to one of the two high voltage outputs of the high voltage power supply. The current flow through ionized air neutralizes and reduces the electrostatic charge in the receiver member to acceptable (negligible non-adverse) values.

The invention, and its objects and advantages, will become more apparent in the detailed description of the preferred embodiment presented below.

BRIEF DESCRIPTION OF THE DRAWINGS

The invention and its objects and advantages will become apparent upon reading the following detailed description and upon reference to the drawings, in which.

DETAILED DESCRIPTION OF THE INVENTION

Figure 1:
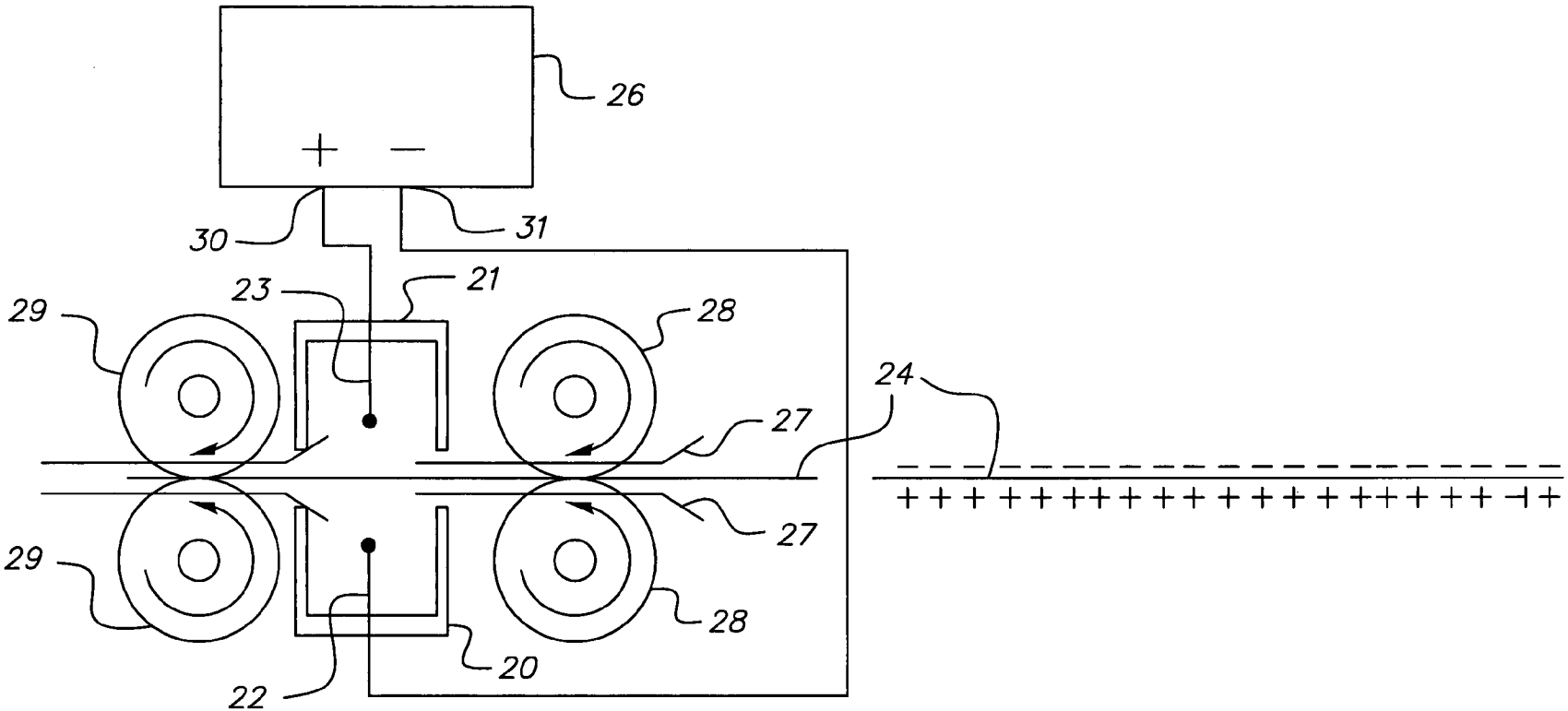
FIG. 1 illustrates a system having opposing wire corona chargers within a sheet transport system.

Referring now to the accompanying drawings, FIG. 1 illustrates a receiver member (sheet) transport system within the field of electrophotographic color reproduction apparatus. Lower corona charger wire 22 and upper corona charger wire 23 are respectively contained within lower wire charger shell 20 and upper wire charger shell 21. The opposing charger wires 22, 23 are paired together and positioned such that they are located downstream of a fusing apparatus (not shown). Receiver members 24 are guided seriatim through input paper guides 27, and urged through the space between the two opposing charger wires 22, 23 by any suitable transport mechanism, such as nip roller pairs 28, 29. The charger wires are driven by the high voltage power supply 26. The two charger wires 22, 23 remove the electrostatic charge that is left over on the receiver members 24 once the reproduction copy has been made and after the fusing process is completed. If the left over charge is not removed from the receiver members 24, the receiver members, when stacked downstream for operator retrieval, may stick to each other causing sheet-handling problems such as dishevelment in the stacking operation and/or difficulties in separating the sheets for subsequent finishing operations.

The preset invention is directed towards the high voltage power supply 26 that is used for the electrostatic discharging of receiver members from sheet-fed reproduction apparatus. The power supply 26 has two high voltage outputs 30, 31, each of which is RMS current regulated and peak to peak voltage limited with a regulated DC offset voltage. The two high voltage outputs 30, 31 of the high voltage power supply 26 are respectively connected to the corona charger wires 22, 23. The output voltage is a trapezoidal waveform with a 400 Hz AC frequency. The voltage waveforms of the upper and the lower charger are synchronized at 180 degrees apart to provide maximum current flow between the wires 22, 23. That current flow, through the ionized air, reduces the electrostatic charge in the receiver sheets to acceptable (negligible non-adverse) values.

One incoming receiver member (24) is shown with a polar charge that results in a difference of electrical potential between the top and bottom surfaces of the member sheet. The outputs 30, 31 of power supply (26) are respectively labeled "+" and "−" to indicate the DC offset polarity of each output. The diagram further illustrates the connection of each output to the proper corona wire such that the polarity of the potential between the charger wires will be in opposition to the polarity of the charge on the receiver member.

Figure 2:
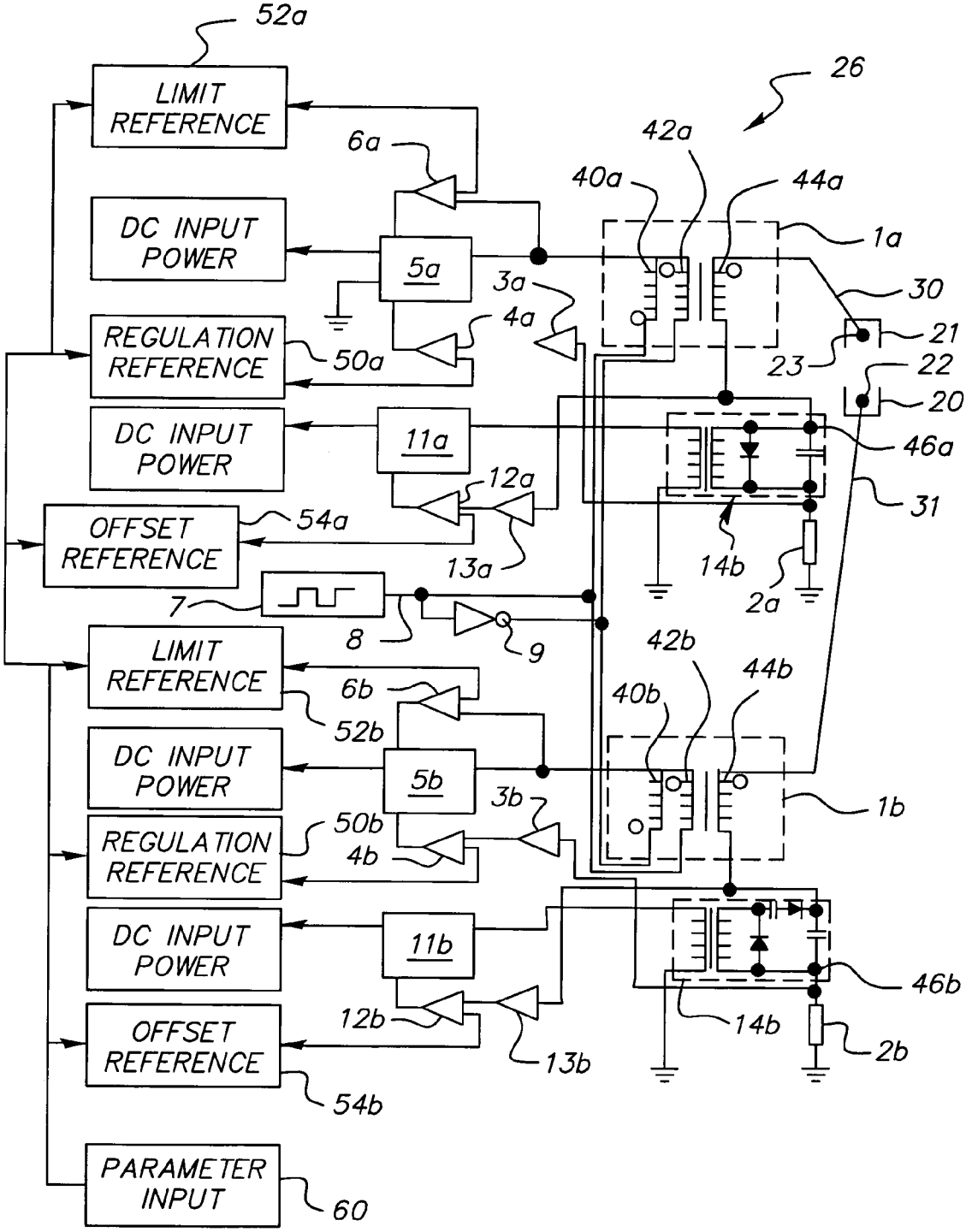
FIG. 2 schematically illustrates the power supply circuit diagram of the present invention.

FIG. 2 schematically illustrates a circuit diagram for the power supply 26. The preferred embodiment of power supply 26 includes two nearly identical circuits, one for driving each of the two AC output transformers 1*a*, 1*b* for boosting a low voltage input to a high voltage (3-20 KVpp) AC output that energizes the corona wire chargers 22,23. Each output transformer 1*a*, 1*b* has two primary windings 40*a*, 40*b*, 42*a*, 42*b*, and secondary winding 44*a*, 44*b*. Resistors 2*a*, 2*b* in series between the ground plane and the return 46*a*, 46*b* of the high voltage secondary windings 44*a*, 44*b* respectively of the transformers 1*a*, 1*b* function as current sense elements. The voltage developed across resistors 2*a*, 2*b* reflects the current sourced by the secondary windings 44*a*, 44*b* of transformers 1*a*, 1*b*. Those voltage signals are AC coupled respectively to conditioning circuits 3*a*, 3*b* which are RMS to DC converters. The signals conditioned by the conditioning circuits 3*a*, 3*b* are then compared to reference signals from a regulation references 50*a*, 50*b* at comparators 4*a*, 4*b*. The reference signals indicate the desired regulated current output set point. In the preferred embodiment these reference signals are analog DC voltage signals and comparators 4*a*, 4*b* are operational amplifiers. The signal conditioning circuits 3*a*, 3*b* reference signals and comparators 4*a*, 4*b* provide functionality that could be achieved with suitable alternate arrangements that will be readily apparent to those of ordinary skill in the art. Among these arrangements are the pulse width modulated signals, frequency modulated signals or digital techniques with parallel or serial reference signals delivered to the power supply, or some combination thereof. The reference signals may be generated internal to the power supply or provided by an external controller. An external controller is used in the preferred embodiment. The output of comparators 4*a*, 4*b* respectively control the low voltage DC-to-DC converters 5*a*, 5*b* which apply the voltage to the primary windings 40*a*, 40*b*, 42*a*, 42*b* of respective transformers 1*a*, 1*b* and adjust that primary voltage to provide a desired regulated current, sourced from the secondary windings 44*a*, 44*b* of transformers 1*a*, 1*b*.

Voltage limit comparators 6*a*, 6*b* respectively monitor the output of low voltage DC-to-DC converters 5*a*, 5*b*. The voltages applied to the primary windings 40*a*, 40*b*, 42*a*, 42*b* of respective transformers 1*a*, 1*b* are compared to reference signals from voltage limit control references 52*a*, 52*b*. These comparators 6*a*, 6*b* and the voltage limit control reference signals are analog in the preferred embodiment. As discussed previously, suitable alternate arrangements may be used for this. Voltage limit comparators 6*a*, 6*b* impose a limit on the maximum output voltage of the respective DC-to-DC converters 5*a*, 5*b*, which in turn limits the maximum voltage that can be applied to the corona wires 22, 23. Alternately, the voltage limit comparison could be made by comparing the high voltage secondary voltage with the voltage limit control reference signal.

As described above, the two high voltage AC outputs 30, 31 of power supply 26 are 180 degrees out of phase. This is accomplished with clock circuit 7. Clock signal 8 and inverted clock signal 9 are connected to opposite sides of primary windings 40*a*, 40*b*, 42*a*, 42*b* of respective transformers 1*a*, 1*b* such that the voltages of the two outputs will be of opposite polarity. In the preferred embodiment, the circuit for transformer 1*a* is located on the same package as the circuit for transformer 1*b*. An alternate arrangement places the two transformer circuits in different packages. In this separate arrangement, the clock signal 8 can be passed from one circuit package to the other via a wired connection. To allow both circuit packages to be the same, electrical connections will be provided for a clock output, a non-inverting clock input and an inverting clock input. The electrical wiring makes connection from the clock output of one circuit package to the non-inverting clock input of that same package, and to the inverting input of the second package. Alternately, the inverting and non-inverting clock inputs could be switched on both packages.

The high voltage DC offsets for the two AC outputs 30, 31 of power supply 26, are generated by DC-to-DC conversion. In the preferred embodiment high voltage DC-to-DC converter output stages 14*a*, 14*b* are respectively inserted between the current sense elements 2*a*, 2*b* and the high voltage secondary windings 44*a*, 44*b* of transformers 1*a*, 1*b*. These DC-to-DC converter output stages 14*a*, 14*b* are inserted at these particular locations to avoid placing them at the higher voltage stress condition on the high side of the AC output transformers 1*a*, 1*b*, and to avoid placing them between ground and the current sense resistors 2*a*, 2*b* which would complicate current sense circuitry. In the preferred embodiment the regulated DC offset voltage levels at the two outputs 30, 31 are equal in magnitude and opposite in polarity. The DC offset voltages are respectively conditioned by circuits 13*a*, 13*b* for comparison to offset reference signals from the offset references 54*a*, 54*b*. The conditioning circuits 13*a*, 13*b* respectively include a voltage divider and buffer. The offset reference signals are DC voltages. As discussed previously, alternate arrangements may be used. The offset reference signals are respectively compared to feedback from the DC offset voltage at comparators 12*a*, 12*b*. The output of the comparators 12*a*, 12*b* respectively adjust the power switching circuits 11*a*, 11*b*, which adjust the voltage on the primary windings of the high voltage DC output stages 14*a*, 14*b*. In the preferred embodiment the magnitude of the high voltage DC output stages can be adjusted in a range from 0 to 1000 V.

The amount of trapped charge on marking particle developed receiver members may vary from sheet to sheet depending on a variety of factors such as:

1. Charge applied to the imaging member
2. Sheet material
3. Image content—percent marking particle coverage of sheet
4. Fusing temperature
5. Process speed The invention allows the reproduction apparatus control system 60, based on operational parameters, to adjust the regulated AC current and DC offset voltage to provide optimum discharging performance through the reference control signals. Based on the various parameters, such as noted above, look up tables are defined for certified receiver member types, known process set points and analysis of digital image files, the reproduction apparatus control system may adjust the performance of the corona chargers such that the remaining charge on marking particle developed receiver members will be below adverse levels after discharging.

The foregoing detailed description has detailed the best mode known to the inventors for practicing the invention. Other embodiment will be obvious to those skilled in the art; therefore, the scope of the invention should be measured by the appended claims.

What is claimed is:

1. A power supply, for driving two opposing corona chargers, comprising:

a first transformer having a first primary winding, a second primary winding, and a secondary winding connected to the first of said opposing corona chargers;

a second transformer having a first primary winding, a second primary winding, and a secondary winding connected to the second of said opposing corona chargers;

a first current sense element, connected to said first transformer;

a second current sense element, connected to said second transformer;

a first current regulation circuit, to adjust the current flowing through said first transformer, said first current regulation circuit responsive to said first current sense element in accordance with a first predetermined parameter;

a second current regulation circuit, to adjust the current flowing through said second transformer, said second current regulation circuit responsive to said second current sense element in accordance with a second predetermined parameter;

a first voltage monitoring circuit, for said first transformer;

a second voltage monitoring circuit, for said second transformer;

a first voltage control circuit, to limit the output voltage of said first transformer to less than a first predetermined voltage, said first voltage control circuit responsive to the output of said first voltage monitoring circuit;

a second voltage control circuit, to limit the output voltage of said second transformer to less than a second predetermined voltage, said second voltage control circuit responsive to the output of said second voltage monitoring circuit;

a first regulated high voltage DC-to-DC converter, to provide a first high voltage DC offset to the output of said first transformer, said first high voltage DC offset adjusted in accordance with a first predetermined offset voltage; and a second regulated high voltage DC-to-DC converter, to provide a second high voltage DC offset to the output of said second transformer, said second high voltage DC offset adjusted in accordance with a second predetermined offset voltage.

2. The power supply of claim 1, wherein said first high voltage DC-to-DC converter is programmed to regulate said first high voltage DC offset through a range of 0-1000 volts and said second high voltage DC-to-DC converter is programmed to regulate said second high voltage DC offset through a range of 0-1000 volts.

3. The power supply of claim 2, wherein said first current sense element is a resistor in series with said secondary winding of said first transformer and said second current sense element is a resistor in series with said secondary winding of said second transformer.

4. The power supply of claim 3, wherein said first current regulation circuit is a first low voltage DC-to-DC converter, programmed to regulate the current in said first transformer by adjusting the voltage of said first transformer, and said second current regulation circuit is a second low voltage DC-to-DC converter, programmed to regulate the current in said second transformer by adjusting the voltage of said second transformer.

5. The power supply of claim 4, wherein said first voltage control circuit is incorporated into said first low voltage DC-to-DC converter and said second voltage control circuit is incorporated into said second low voltage DC-to-DC converter.

6. The power supply of claim 5, further including a clock generation circuit providing positive clock pulses in synchronization with negative clock pulses, said positive clock pulses provided to said first primary winding of said first transformer and to said second primary winding of said second transformer, said negative clock pulses provided to said second primary winding of said first transformer and to said first primary winding of said second transformer, whereby the output of said first transformer is 180 degrees out of phase with the output of said second transformer.

7. A power supply, for driving two opposing corona chargers, comprising:

a first transformer having a first primary winding, a second primary winding, and a secondary winding connected to the first of said opposing corona chargers;

a second transformer having a first primary winding, a second primary winding, and a secondary winding connected to the second of said opposing corona chargers;

a current sense element, connected to said first transformer;

a current regulation circuit, to adjust the current flowing through said first and said second transformers, said current regulation circuit responsive to said current sense element in accordance with a predetermined parameter;

a voltage monitoring circuit, for said first transformer;

a voltage control circuit, to limit the output voltage of said first transformer and said second transformer to less than a predetermined voltage, said voltage control circuit responsive to the output of said voltage monitoring circuit; and a regulated high voltage DC-to-DC converter, to provide a high voltage DC offset to the output of said first transformer and to the output of said second transformer, said high voltage DC offset adjusted in accordance with a predetermined offset voltage.

8. The power supply of claim 7, wherein said high voltage DC-to-DC converter is programmed to regulate said high voltage DC offset through a range of 0-1000 volts.

9. The power supply of claim 8, wherein said current sense element is a resistor in series with said secondary winding of said first transformer.

10. The power supply of claim 9, wherein said current regulation circuit is a low voltage DC-to-DC converter, programmed to regulate the current in said first transformer by adjusting the voltage of said first transformer and in said second transformer by adjusting the voltage of said second transformer.

11. The power supply of claim 10, wherein said voltage control circuit is incorporated into said low voltage DC-to-DC converter.

12. The power supply of claim 11, further including a clock generation circuit providing positive clock pulses in synchronization with negative clock pulses, said positive clock pulses provided to said first primary winding of said first transformer and to said second primary winding of said second transformer, said negative clock pulses provided to said second primary winding of said first transformer and to said first primary winding of said second transformer, wherein the output of said first transformer is 180 degrees out of phase with the output of said second transformer.

13. A power supply, for driving two opposing corona chargers, comprising:

a first transformer having a first primary winding, a second primary winding, and a secondary winding connected to the first of said opposing corona chargers;

a second transformer having a first primary winding, a second primary winding, and a secondary winding connected to the second of said opposing corona chargers;

a first low voltage DC-to-DC converter, with output connected to both the said first and said second primary windings of said first transformer;

a second low voltage DC-to-DC converter, with output connected to both the said first and said second primary windings of said second transformer;

a first current sense element, connected to said secondary winding of said first transformer;

a second current sense element, connected to said secondary winding of said second transformer;

a first current comparator circuit, connected to a first input of said first low voltage DC-to-DC converter, responsive to said first current sense element, to compare the current flowing through said secondary winding of said first transformer to a first reference current;

a second current comparator circuit, connected to a first input of said second low voltage DC-to-DC converter, responsive to said second current sense element, to compare the current flowing through said secondary winding of said second transformer to a second reference current;

a first voltage comparator circuit, connected to a second input of said first low voltage DC-to-DC converter, to compare the output voltage of said first low voltage DC-to-DC converter to a first reference voltage;

a second voltage comparator circuit, connected to a second input of said second low voltage DC-to-DC converter, to compare the output voltage of said second low voltage DC-to-DC converter to a second reference voltage;

a first regulated high voltage DC-to-DC converter, to provide a high voltage DC offset to the output of said first transformer; and a second regulated high voltage DC-to-DC converter, to provide said high voltage DC offset to the output of said second transformer.

14. The power supply of claim 13, wherein said first and said second high voltage DC-to-DC converters are programmed to regulate said high voltage DC offset through a range of 0-1000 volts.

15. The power supply of claim 14, wherein said first current sense element is a resistor, in series with said secondary winding of said first transformer and said second current sense element is a resistor, in series with said secondary winding of said second transformer.

16. The power supply of claim 15, further including a clock generation circuit providing positive clock pulses in synchronization with negative clock pulses, said positive clock pulses provided to said first primary winding of said first transformer and to said second primary winding of said second transformer, said negative clock pulses provided to said second primary winding of said first transformer and to said first primary winding of said second transformer, wherein the output of said first transformer is 180 degrees out of phase with the output of said second transformer.

17. The power supply of claim 16, wherein said first low voltage DC-to-DC converter is programmed to regulate the current to said first and said second primary windings of said first transformer in response to said first current comparator circuit and to limit the voltage applied to said first and said second primary windings of said first transformer in response to said first voltage comparator circuit; and wherein said second low voltage DC-to-DC converter is programmed to regulate the current to said first and said second primary windings of said second transformer in response to said second current comparator circuit and to limit the voltage applied to said first and said second primary windings of said second transformer in response to said second voltage comparator circuit.

18. A power supply, for driving two opposing corona chargers, comprising:

a first transformer having a first primary winding, a second primary winding, and a secondary winding connected to the first of said opposing corona chargers;

a second transformer having a first primary winding, a second primary winding, and a secondary winding connected to the second of said opposing corona chargers;

a low voltage DC-to-DC converter, with output connected to both the said first and said second primary windings of both said first and said second transformers;

a current sense element, connected to said secondary winding of said first transformer;

a current comparator circuit, connected to a first input of said low voltage DC-to-DC converter, responsive to said current sense element, to compare the current flowing through said secondary winding of said first transformer to a reference current;

a voltage comparator circuit, connected to a second input of said low voltage DC-to-DC converter, to compare the output voltage of said low voltage DC-to-DC converter to a reference voltage;

a first regulated high voltage DC-to-DC converter, to provide a high voltage DC offset to the output of said first transformer; and a second regulated high voltage DC-to-DC converter, to provide said high voltage DC offset to the output of said second transformer.

19. The power supply of claim 18, wherein said first and said second high voltage DC-to-DC converters are programmed to regulate said high voltage DC offset through a range of 0-1000 volts.

20. The power supply of claim 19, wherein said current sense element is a resistor, in series with said secondary winding of said first transformer.

21. The power supply of claim 20, further includes a clock generation circuit providing positive clock pulses in synchronization with negative clock pulses, said positive clock pulses provided to said first primary winding of said first transformer and to said second primary winding of said second transformer, said negative clock pulses provided to said second primary winding of said first transformer and to said first primary winding of said second transformer, wherein the output of said first transformer is 180 degrees out of phase with the output of said second transformer.

22. The power supply of claim 21, wherein said low voltage DC-to-DC converter is programmed to regulate the current to said first and said second primary windings of both said first and said second transformers in response to said current comparator circuit and to limit the voltage applied to both said first and said second primary windings of both said first and said second transformers in response to said voltage comparator circuit.

23. A method of powering two opposing corona chargers comprising the steps of:

a. connecting to the first of said opposing corona chargers a first transformer having a first primary winding, a second primary winding, and a secondary winding;

b. connecting to the second of said opposing corona chargers a second transformer having a first primary winding, a second primary winding, and a secondary winding;

c. sensing the current flowing 1) in said secondary winding of said first transformer with a first current sense element and 2) in said secondary winding of said second transformer with a second current sense element;

d. comparing the current flowing 1) in said secondary winding of said first transformer with a first reference current to create a first current comparison signal and 2) in said secondary winding of said second transformer with a second reference current to create a second current comparison signal;

e. connecting 1) said first current comparison signal to a first input of a first low voltage DC-to-DC converter, said first low voltage DC-to-DC converter having an output connected to said first and said second primary windings of said first transformer, and 2) said second current comparison signal to a first input of a second low voltage DC-to-DC converter, said second low voltage DC-to-DC converter having an output connected to said first and said second primary windings of said second transformer;

f. comparing 1) the output voltage of said first low voltage DC-to-DC converter with a first reference voltage to create a first voltage comparison signal and 2) the output voltage of said second low voltage DC-to-DC converter with a second reference voltage to create a second voltage comparison signal;

g. connecting 1) said first voltage comparison signal to a second input of said first low voltage DC-to-DC converter and 2) said second voltage comparison signal to a second input of said second low voltage DC-to-DC converter;

h. programming 1) said first low voltage DC-to-DC converter to regulate the current to said first and said second windings of said first transformer in response to said first current comparison signal and to limit the voltage applied to said first and said second windings of said first transformer in response to said first voltage comparison signal and 2) said second low voltage DC-to-DC converter to regulate the current to said first and said second windings of said second transformer in response to said second current comparison signal and to limit the voltage applied to said first and said second windings of said second transformer in response to said second voltage comparison signal;

i. connecting 1) a first high voltage DC-to-DC converter to said secondary winding of said first transformer to provide a first high voltage DC offset to the output of said first transformer and 2) a second high voltage DC-to-DC converter to said secondary winding of said second transformer to provide a second high voltage DC offset to the output of said second transformer; and j. generating positive clock pulses in synchronization with negative clock pulses, connecting said positive clock pulses to said first primary winding of said first transformer and to said second primary winding of said second transformer, and connecting said negative clock pulses to said second primary winding of said first transformer and to said first primary winding of said second transformer, wherein the output of said first transformer is 180 degrees out of phase with the output of said second transformer.

24. A method of powering two opposing corona chargers comprising the steps of:

a. connecting to the first of said opposing corona chargers a first transformer having a first primary winding, a second primary winding, and a secondary winding;

b. connecting to the second of said opposing corona chargers a second transformer having a first primary winding, a second primary winding, and a secondary winding;

c. sensing the current flowing in said secondary winding of said first transformer with a current sense element;

d. comparing the current flowing in said secondary winding of said first transformer with a reference current to create a current comparison signal;

e. connecting said current comparison signal to a first input of a low voltage DC-to-DC converter, said low voltage DC-to-DC converter having an output connected to said first and said second primary windings of said first and said second transformers;

f. comparing the output voltage of said low voltage DC-to-DC converter with a reference voltage to create a voltage comparison signal;

g. connecting said voltage comparison signal to a second input of said low voltage DC-to-DC converter;

h. programming said low voltage DC-to-DC converter to regulate the current to said first and said second windings of said first and said second transformers in response to said current comparison signal and to limit the voltage applied to said first and said second windings of said first and said second transformers in response to said first voltage comparison signal;

i. connecting a high voltage DC-to-DC converter to said secondary winding of said first transformer and to said secondary winding of said second transformer to provide a high voltage DC offset to the output of said first transformer and to the output of said second transformer; and j. generating positive clock pulses in synchronization with negative clock pulses, connecting said positive clock pulses to said first primary winding of said first transformer and to said second primary winding of said second transformer, and connecting said negative clock pulses to said second primary winding of said first transformer and to said first primary winding of said second transformer, wherein the output of said first transformer is 180 degrees out of phase with the output of said second transformer.

25. A method for discharging a polar charge on successive marking particle-bearing receiver members transported along a path between opposed corona chargers electrically connected of a power supply having a first transformer and second transformer, said discharging method comprising the steps of:

a. supplying a sensed AC current from said first transformer of said power supply to one of said opposed corona chargers;

b. applying a senses AC current from said second transformer of said power supply to the other of said opposed corona chargers;

c. synchronizing application of sensed AC current to said one opposed corona charger with application of sensed AC current to said other opposed corona charge, whereby the sensed AC current to said one opposed corona charger is 180 degrees out of phase with the sensed AC current to said other opposed corona charger;

d. applying a DC voltage to said first transformer and said second transformer as an offset to the sensed AC current from said first transformer and the sensed AC current from said second transformer; and e. regulating the DC voltage to said first transformer and said second transformer on the basis of predetermined parameters which affect the amount of polar charge on successive marking particle-bearing receiver members so as to provide necessary output from said opposed corona chargers to optimally discharge the polar charge thereon.

* * * * *